US008282759B2

(12) United States Patent
Piramoon et al.

(10) Patent No.: US 8,282,759 B2
(45) Date of Patent: Oct. 9, 2012

(54) METHOD OF MAKING A COMPOSITE SWING BUCKET CENTRIFUGE ROTOR

(75) Inventors: Sina Piramoon, San Jose, CA (US); David Sebio, Gualala, CA (US); Alireza Piramoon, Santa Clara, CA (US)

(73) Assignee: Fiberlite Centrifuge, LLC, Santa Clara, CA (US)

( * ) Notice: Subject to any disclaimer, the term of this patent is extended or adjusted under 35 U.S.C. 154(b) by 0 days.

(21) Appl. No.: 13/433,773

(22) Filed: Mar. 29, 2012

(65) Prior Publication Data

US 2012/0180941 A1 Jul. 19, 2012

Related U.S. Application Data

(62) Division of application No. 12/355,942, filed on Jan. 19, 2009, now Pat. No. 8,147,393.

(51) Int. Cl.
*B65H 81/00* (2006.01)

(52) U.S. Cl. ..... 156/185; 156/172

(58) Field of Classification Search ..... 494/17–21, 494/31, 33, 43, 81; 74/572.11–572.12; 156/160–192; 242/433
See application file for complete search history.

(56) References Cited

U.S. PATENT DOCUMENTS

| | | | | | |
|---|---|---|---|---|---|
| 596,338 | A | * | 12/1897 | Salenius | 494/81 |
| 963,073 | A | * | 7/1910 | Salenius | 494/81 |
| 3,602,066 | A | * | 8/1971 | Wetherbee, Jr. | 74/572.21 |
| 3,797,737 | A | * | 3/1974 | Kadotani et al. | 494/81 |
| 3,913,828 | A | * | 10/1975 | Roy | 494/81 |
| 4,020,714 | A | * | 5/1977 | Rabenhorst | 74/572.12 |
| 4,023,437 | A | * | 5/1977 | Rabenhorst | 74/572.12 |
| 4,036,080 | A | * | 7/1977 | Friedericy et al. | 74/572.11 |
| 4,093,118 | A | | 6/1978 | Sinn et al. | |
| 4,123,949 | A | * | 11/1978 | Knight et al. | 74/572.21 |
| 4,176,563 | A | * | 12/1979 | Younger | 74/572.2 |
| 4,183,259 | A | * | 1/1980 | Giovachini et al. | 74/572.1 |
| 4,207,778 | A | * | 6/1980 | Hatch | 74/572.12 |
| 4,266,442 | A | * | 5/1981 | Zorzi | 74/572.12 |
| 4,285,251 | A | * | 8/1981 | Swartout | 74/572.12 |
| 4,341,001 | A | * | 7/1982 | Swartout | 29/894 |

(Continued)

FOREIGN PATENT DOCUMENTS

DE 1782602 B 3/1972

(Continued)

OTHER PUBLICATIONS

Espacenet, English Translation of DE1782602(B), retrieved from http://worldwide.espacenet.com, Publication Date Mar. 16, 1972 (7 pages).

(Continued)

*Primary Examiner* — Charles E Cooley
(74) *Attorney, Agent, or Firm* — Wood, Herron & Evans, LLP

(57) ABSTRACT

A centrifuge rotor includes a rotor body having a central hub and first and second bucket receiving spaces defined on diametrically opposed sides of the rotor body. A first pair of bucket supports is supported by the rotor body for pivotally supporting a swing bucket in the first bucket receiving space, and a second pair of bucket supports is supported by the rotor body for pivotally supporting a swing bucket in the second bucket receiving space. The rotor further includes reinforcing material wound around oppositely disposed ones of the first and second pairs of bucket supports.

3 Claims, 7 Drawing Sheets

U.S. PATENT DOCUMENTS

| | | | | | |
|---|---|---|---|---|---|
| 4,359,912 | A | * | 11/1982 | Small | 74/572.12 |
| 4,391,597 | A | * | 7/1983 | Piramoon et al. | 494/20 |
| 4,435,168 | A | | 3/1984 | Kennedy | |
| 4,443,727 | A | * | 4/1984 | Annen et al. | 310/423 |
| 4,449,966 | A | * | 5/1984 | Piramoon | 494/20 |
| 4,468,269 | A | * | 8/1984 | Carey | 156/175 |
| 4,481,840 | A | * | 11/1984 | Friedericy et al. | 74/572.1 |
| 4,501,565 | A | * | 2/1985 | Piramoon | 494/85 |
| 4,502,349 | A | * | 3/1985 | Abiven et al. | 74/572.1 |
| 4,548,596 | A | * | 10/1985 | Sutton et al. | 494/20 |
| 4,585,433 | A | * | 4/1986 | Cole | 494/20 |
| 4,585,434 | A | * | 4/1986 | Cole | 494/20 |
| 4,586,918 | A | * | 5/1986 | Cole | 494/20 |
| 4,589,864 | A | * | 5/1986 | Cole | 494/20 |
| 4,624,655 | A | * | 11/1986 | Cole | 494/20 |
| 4,659,325 | A | * | 4/1987 | Cole et al. | 494/20 |
| 4,670,004 | A | * | 6/1987 | Sharples et al. | 494/20 |
| 4,675,001 | A | * | 6/1987 | Johanson | 494/85 |
| 4,701,157 | A | * | 10/1987 | Potter | 494/16 |
| 4,738,656 | A | * | 4/1988 | Piramoon et al. | 494/81 |
| 4,781,669 | A | * | 11/1988 | Piramoon | 494/16 |
| 4,790,808 | A | * | 12/1988 | Piramoon | 494/81 |
| 4,817,453 | A | * | 4/1989 | Breslich et al. | 74/572.4 |
| 4,824,429 | A | * | 4/1989 | Keunen et al. | 494/16 |
| 4,860,610 | A | * | 8/1989 | Popper et al. | 74/572.4 |
| 4,886,486 | A | * | 12/1989 | Grimm et al. | 494/20 |
| 4,991,462 | A | * | 2/1991 | Breslich et al. | 74/572.4 |
| 5,057,071 | A | * | 10/1991 | Piramoon | 494/16 |
| 5,206,988 | A | * | 5/1993 | Piramoon | 29/889 |
| 5,362,301 | A | * | 11/1994 | Malekmadani et al. | 494/16 |
| 5,376,199 | A | * | 12/1994 | Humphrey et al. | 156/172 |
| 5,382,219 | A | * | 1/1995 | Malekmadani | 494/16 |
| 5,411,465 | A | | 5/1995 | Glen et al. | |
| 5,505,684 | A | * | 4/1996 | Piramoon | 494/16 |
| 5,527,257 | A | * | 6/1996 | Piramoon | 494/20 |
| 5,533,644 | A | | 7/1996 | Glen et al. | |
| 5,540,126 | A | * | 7/1996 | Piramoon | 83/34 |
| 5,545,118 | A | * | 8/1996 | Romanauskas | 494/20 |
| 5,562,582 | A | * | 10/1996 | Malekmadani | 494/16 |
| 5,562,584 | A | * | 10/1996 | Romanauskas | 494/20 |
| 5,601,522 | A | * | 2/1997 | Piramoon | 494/16 |
| 5,643,168 | A | * | 7/1997 | Piramoon et al. | 494/16 |
| 5,683,341 | A | | 11/1997 | Giebeler | |
| 5,759,592 | A | * | 6/1998 | Piramoon et al. | 425/414 |
| 5,776,400 | A | * | 7/1998 | Piramoon et al. | 264/219 |
| 5,833,908 | A | * | 11/1998 | Piramoon et al. | 264/250 |
| 5,846,364 | A | * | 12/1998 | Policelli | 156/169 |
| 5,876,322 | A | * | 3/1999 | Piramoon | 494/16 |
| 5,972,264 | A | * | 10/1999 | Malekmadani et al. | 264/102 |
| 6,056,910 | A | * | 5/2000 | Fritsch et al. | 264/319 |
| 6,296,798 | B1 | * | 10/2001 | Piramoon | 264/257 |
| 6,482,342 | B1 | | 11/2002 | Malekmadani et al. | |
| 6,916,282 | B2 | | 7/2005 | Aizawa | |
| 7,150,708 | B2 | | 12/2006 | Lurz | |
| 8,147,392 | B2 | * | 4/2012 | Piramoon et al. | 494/16 |
| 8,147,393 | B2 | * | 4/2012 | Piramoon et al. | 494/20 |
| 8,211,002 | B2 | * | 7/2012 | Piramoon et al. | 494/20 |
| 2010/0018344 | A1 | * | 1/2010 | Spears et al. | 74/572.12 |
| 2010/0184578 | A1 | * | 7/2010 | Piramoon et al. | 494/20 |
| 2010/0216622 | A1 | * | 8/2010 | Piramoon et al. | 494/21 |
| 2010/0273626 | A1 | * | 10/2010 | Piramoon | 494/20 |
| 2010/0273629 | A1 | * | 10/2010 | Piramoon et al. | 494/80 |
| 2011/0023636 | A1 | * | 2/2011 | Atkins et al. | 74/5.95 |
| 2011/0111942 | A1 | * | 5/2011 | Piramoon | 494/16 |
| 2011/0136647 | A1 | * | 6/2011 | Piramoon et al. | 494/20 |
| 2012/0180941 | A1 | * | 7/2012 | Piramoon et al. | 156/185 |
| 2012/0186731 | A1 | * | 7/2012 | Piramoon et al. | 156/172 |

FOREIGN PATENT DOCUMENTS

| | | | | |
|---|---|---|---|---|
| DE | 2749785 | A1 | | 5/1979 |
| EP | 0176970 | A2 | | 4/1986 |
| EP | 225610 | A2 | * | 6/1987 |
| EP | 0326680 | A2 | | 8/1989 |
| JP | 56111063 | A | * | 9/1981 |
| JP | 58219958 | A | * | 12/1983 |
| JP | 60090057 | A | * | 5/1985 |
| JP | 60118259 | A | * | 6/1985 |
| JP | 61101262 | A | * | 5/1986 |
| JP | 63-319074 | A | | 12/1988 |
| JP | 63319074 | A | * | 12/1988 |
| JP | 01135550 | A | * | 5/1989 |
| JP | 06071801 | A | * | 3/1994 |
| JP | 2010162538 | A | * | 7/2010 |
| JP | 2010253467 | A | * | 11/2010 |
| WO | WO 9102302 | A1 | * | 2/1991 |
| WO | WO 9325315 | A1 | * | 12/1993 |
| WO | WO 9415714 | A1 | * | 7/1994 |
| WO | WO 9635156 | A1 | * | 11/1996 |
| WO | WO 9855237 | A1 | * | 12/1998 |

OTHER PUBLICATIONS

Espacenet, English Translation of DE2749785(A1), retrieved from http://worldwide.espacenet.com, Publication Date May 10, 1979 (5 pages).

Espacenet, English Translation of EP0326680(A2), retrieved from http://worldwide.espacenet.com, Publication Date Aug. 9, 1989 (7 pages).

European Patent Office, International Search Report and Written Opinion of the International Searching Authority, International Application No. PCT/US2010/059231, Date Mar. 8, 2011 (10 pages).

United Kingdom Intellectual Property Office, Search and Examination Report in British Patent Application No. GB1000530.4 dated Apr. 30, 2010 (5 pages).

* cited by examiner

METHOD OF MAKING A COMPOSITE SWING BUCKET CENTRIFUGE ROTOR

This application is a divisional of U.S. patent application Ser. No. 12/355,942, filed Jan. 19, 2009, now U.S. Pat. No. 8,147,393, the disclosure of which is hereby incorporated herein by reference in its entirety.

FIELD OF THE INVENTION

This invention relates generally to centrifuge rotors and, more specifically, to a swing bucket rotor for use in a high-speed centrifuge.

BACKGROUND OF THE INVENTION

Centrifuges are used to separate components of collected samples of biological and other materials. The samples are typically placed in tubes or other containers configured to be received in a centrifuge rotor for rapid rotation in the centrifuge. One type of centrifuge rotor includes swinging buckets pivotally coupled to a rotor body to permit the longitudinal axes of sample tubes or containers carried on the buckets to rotate from a generally vertical orientation to a generally horizontal orientation as the rotor spins during centrifugation. To balance the dynamic forces experienced during centrifugation, swing bucket rotors are typically designed to support the swing buckets in a generally symmetric arrangement around the rotational axis.

One configuration of a swing bucket centrifuge rotor supports two swing buckets on diametrically opposite sides of the rotational axis of the rotor. Swing bucket rotors of this configuration are commonly referred to as "H-rotors" due to the generally H shape of the rotor body formed by the diametrically opposed spaces for receiving the swing buckets. Exemplary H-rotors include the IEC TWO-PLACE ROTOR for the CENTRA-CL5 CENTRIFUGE, both commercially available from Thermo Fisher Scientific Inc. of Waltham, Mass.

Because centrifuge rotors are rotated at very high speeds during centrifugation, the rotor bodies must be able to withstand the dynamic stresses and forces generated by the rapid rotation of the swing buckets about a central rotational axis. A need therefore exists for improved swing bucket rotors, such as H-rotors, that overcome these and other drawbacks of conventional centrifuge rotors.

SUMMARY OF THE INVENTION

The present invention overcomes the foregoing and other shortcomings and drawbacks of swing bucket rotors, such as H-rotors, heretofore known for use for centrifugation. While the invention will be discussed in connection with certain embodiments, it will be understood that the invention is not limited to these embodiments. On the contrary, the invention includes all alternatives, modifications, and equivalents as may be included within the spirit and scope of the invention.

In one aspect, a centrifuge rotor includes a rotor body having a central hub and first and second bucket receiving spaces defined on diametrically opposed sides of the rotor body. A first pair of bucket supports is supported by the rotor body for pivotally supporting a swing bucket in the first bucket receiving space, and a second pair of bucket supports is supported by the rotor body for pivotally supporting a swing bucket in the second bucket receiving space. The rotor further includes reinforcing material wound around oppositely disposed ones of the first and second pairs of bucket supports. In one embodiment, the reinforcing material comprises carbon fiber material. In another embodiment, the rotor body comprises carbon fiber laminates.

In another aspect, a method of making a centrifuge rotor includes locating first and second pairs of bucket supports on a rotor body for pivotally supporting first and second swing buckets on diametrically opposed sides of the rotor body. Reinforcing material is wound around one of the first pair of bucket supports and an oppositely disposed one of the second pair of bucket supports. Reinforcing material is also wound around the other of the first pair of bucket supports and the other one of the oppositely disposed second pair of bucket supports. In one embodiment, the reinforcing material comprises resin-coated carbon fibers.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE INVENTION

Figure 1:
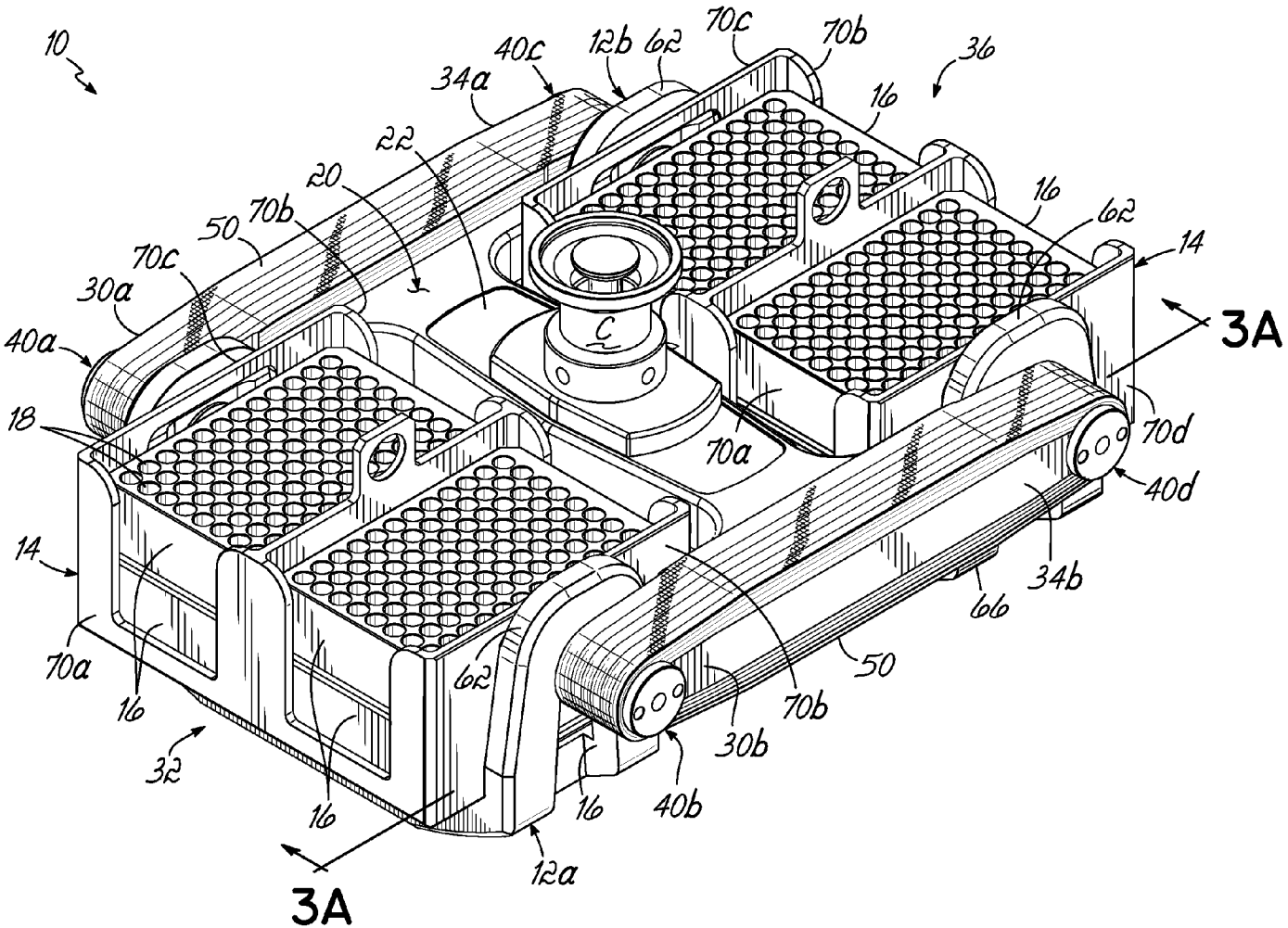
FIG. 1 is a perspective view of an exemplary composite H-rotor system according to one embodiment of the present invention.

Referring to the figures, FIG. 1 depicts an exemplary centrifuge rotor assembly 10 in accordance with one embodiment of the present invention. The centrifuge rotor assembly 10 includes first and second swing buckets 12*a*, 12*b* supporting carriers 14 for housing microplates 16 having a plurality of wells 18 that receive samples or for housing tube racks (not shown) that receive sample tubes or other containers for centrifugation. In the embodiment shown, each carrier 14 houses tandem stacks of microplates 16, with two microplates 16 in each stack. It will be appreciated, however, that various other types of microplates 16 and carriers 14 may alternatively be supported on swing buckets 12*a*, 12*b*, or that various other configurations of swing buckets may be used to facilitate centrifugation of collected samples in other types of containers.

Figure 2A:
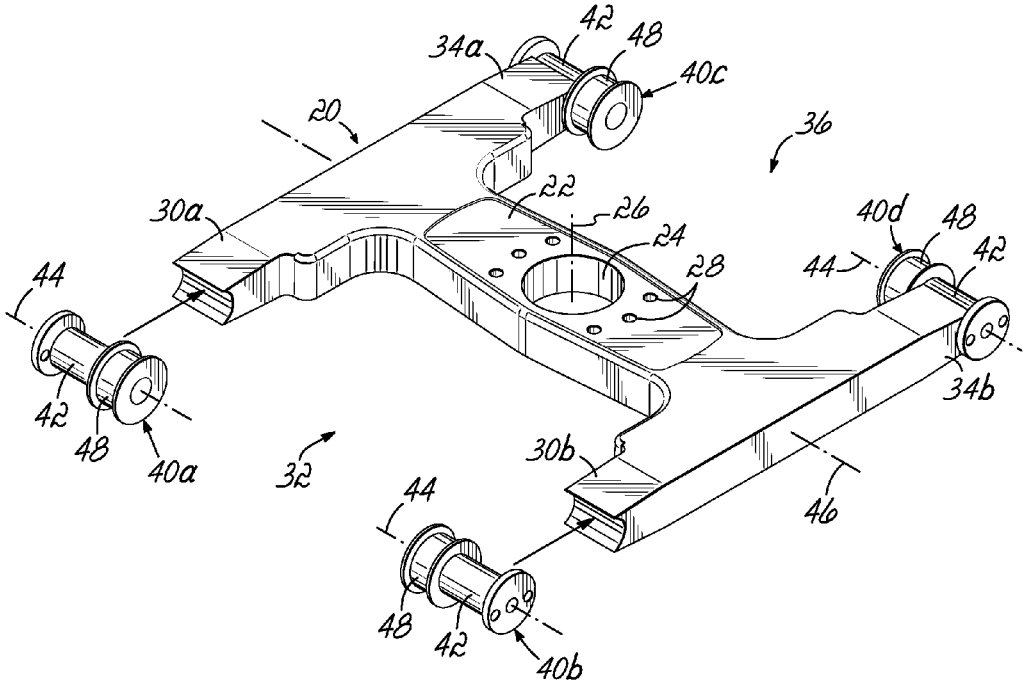
FIG. 2A is a partially exploded perspective view of a rotor body of the composite H-rotor assembly of FIG. 1, illustrating the mounting of bucket supports on the rotor body.

With continued reference to FIG. 1, and referring further to FIG. 2A, the centrifuge rotor assembly 10 comprises a rotor body 20 having a central hub 22 with a bore 24 therethrough for receiving a coupling C that secures the rotor body 20 to a centrifuge spindle S (shown in FIGS. 3A and 3B) for rotation of the rotor body 20 about rotational axis 26. In the embodiment shown, the rotor body 20 further includes a plurality of apertures 28 disposed proximate the bore 24 and configured to receive corresponding projections (not shown) on the coupling C. In one embodiment, the central hub 22 is generally elongate in shape and a first pair of spaced arms 30*a*, 30*b* extends outwardly from central hub 22 to define a first bucket receiving space 32. A second pair of spaced arms 34*a*, 34*b* extends outwardly from the central hub 22 in a direction opposite the first pair of arms 30*a*, 30*b* to define a second bucket receiving space 36.

In one embodiment, the rotor body 20 may be formed from resin-coated, carbon fiber sheets or laminates that have been stacked and compression molded to form a unitary structure. The compression molded rotor body 20 may further include metallic inserts defining portions of the rotor body 20, such as portions of the central hub 22. It will be appreciated that various other materials and methods may be used to form the rotor body 20. For example, the rotor body 20 may alternatively be formed, wholly or in part, from polymers, metals including steel, titanium, or aluminum, or from various other materials suitable for forming a rotor body for use in centrifugation.

A first pair of bucket supports 40*a*, 40*b* is provided on the first arms 30*a*, 30*b*, and a second pair of bucket supports 40*c*, 40*d* is provided on the second arms 34*a*, 34*b* for pivotally supporting the first and second swing buckets 12*a*, 12*b*, respectively, in the first and second bucket receiving spaces 32, 36 of the rotor body 20. In the embodiment shown, each bucket support 40*a*, 40*b*, 40*c*, 40*d* comprises a pin 42 having a longitudinal axis 44 aligned substantially parallel with a longitudinal axis 46 of the central hub, and a bushing or trunion 48 coupled to the pin 42. It will be appreciated that the bucket supports 40*a*, 40*b*, 40*c*, 40*d* may alternatively comprise various other structure suitable for pivotally supporting swing buckets 12*a*, 12*b* within the bucket receiving spaces 32, 36. As non-limiting examples, the bucket supports 40*a*, 40*b*, 40*c*, 40*d* may alternatively comprise pins without trunions, or may comprise structure defining journals for receiving corresponding pins structure associated with a swing bucket 12*a*, 12*b*. When the rotor body 20 is formed from compression molded carbon fiber material, or other moldable materials, the bucket supports 40*a*, 40*b*, 40*c*, 40*d* may be integrally molded with the rotor body 20. Alternatively, the bucket supports 40*a*, 40*b*, 40*c*, 40*d* may be secured to the rotor body 20 using adhesives or any other suitable process for securely mounting the bucket supports 40*a*, 40*b*, 40*c*, 40*d* to the rotor body 20.

Figure 2B:
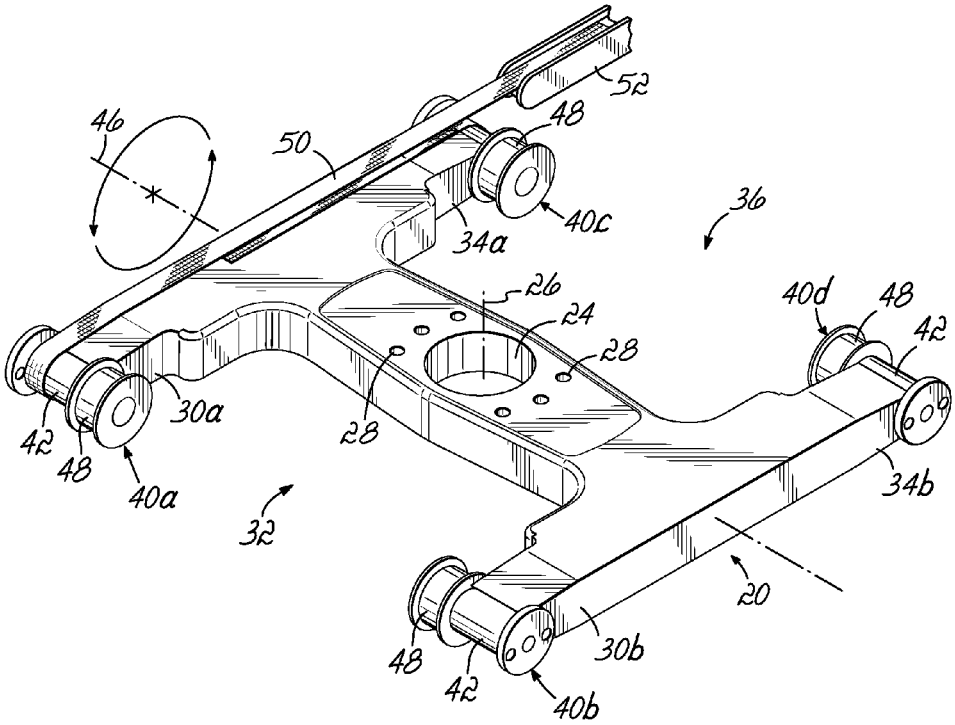
FIGS. 2B and 2C are perspective views of the rotor body of FIG. 2A, illustrating the winding of carbon fiber tows about the bucket supports of the rotor body.
Figure 2C:
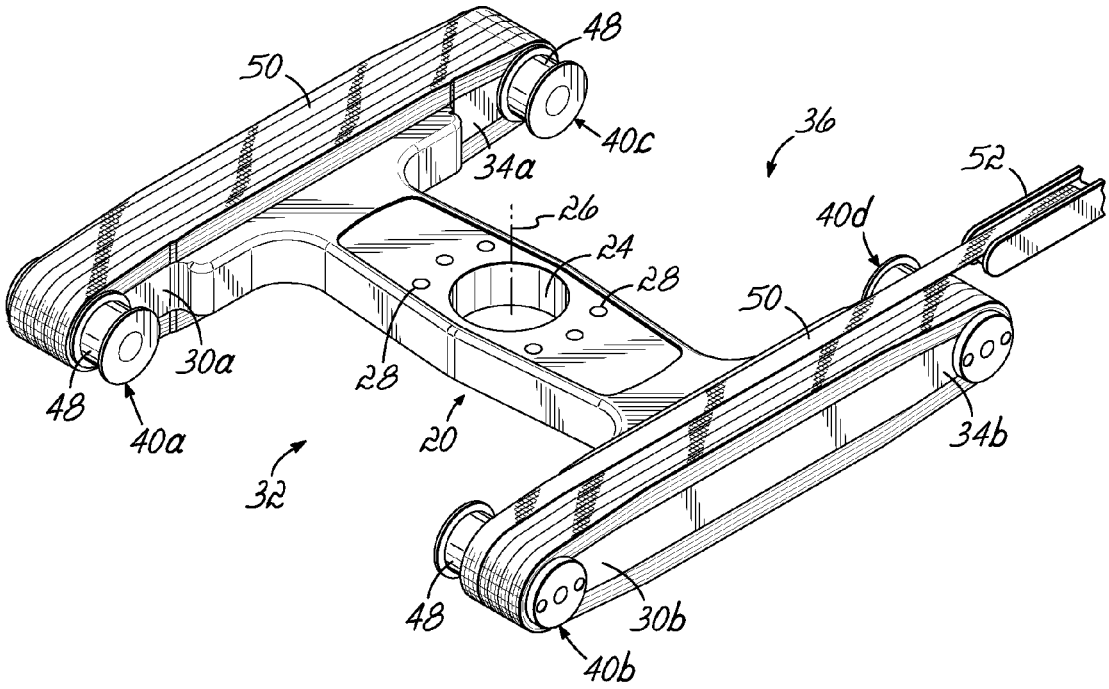

With continued reference to FIG. 1 and referring to FIGS. 2B and 2C, the centrifuge rotor assembly 10 further includes reinforcement material 50 wound around oppositely disposed bucket supports 40*a*, 40*b*, 40*c*, 40*d*. Specifically, the reinforcing material is wound around one of the first pair of bucket supports 40*a* and an oppositely disposed one of the second pair of bucket supports 40*c*, as depicted in FIG. 2B. Similarly, reinforcing material 50 is wound around the other one of the first pair of buckets supports 40*b* and the other oppositely disposed one of the second pair of bucket supports 40*d*, as depicted in FIG. 2C. FIGS. 2B and 2C further illustrate an exemplary method of winding the reinforcing material 50 around the respective oppositely disposed bucket supports 40*a*, 40*b*, 40*c*, 40*d*, wherein a the reinforcing material 50 is directed by a guide 52 onto the rotor body 20 to extend along the respective arms 30*a*, 30*b*, 34*a*, 34*b* and around the respective bucket supports 40*a*, 40*b*, 40*c*, 40*d*. In one embodiment, the reinforcing material 50 may be wound around the respective bucket supports 40*a*, 40*b*, 40*c*, 40*d* and arms 30*a*, 30*b*, 34*a*, 34*b* by rotating the rotor body 20 about the longitudinal axis 26 through the central hub 22, while directing the path of the reinforcing material 50 with the guide 52. Alternatively, the rotor body 20 may be held fixed and the guide 52 may be moved in an orbital path around the respective bucket supports 40*a*, 40*b*, 40*c*, 40*d* and arms 30*a*, 30*b*, 34*a*, 34*b* while directing the reinforcing material 50 onto the rotor body 20.

While reinforcing material 50 has been depicted herein being wound around bucket supports 40*a*, 40*b*, 40*c*, 40*d* and arms 30*a*, 30*b*, 34*a*, 34*b* in a sequential operation, it will be appreciated that reinforcing material 50 may alternatively be simultaneously wound around the opposed pairs of bucket supports 40*a*, 40*b*, 40*c*, 40*d* and arms 30*a*, 30*b*, 34*a*, 34*b*.

In one embodiment, the reinforcing material 50 comprises resin-coated carbon fiber tows, such as 24K carbon fiber tows commercially available from Toray Industries, Inc. of Tokyo, Japan. After the carbon fiber tows have been wound around the respective bucket supports 40*a*, 40*b*, 40*c*, 40*d* and arms 30*a*, 30*b*, 34*a*, 34*b* as discussed above, the reinforcing material 50 may be cured by applying heat and/or pressure to the carbon fiber wound rotor body 20 to form a substantially integral structure.

Figure 2D:
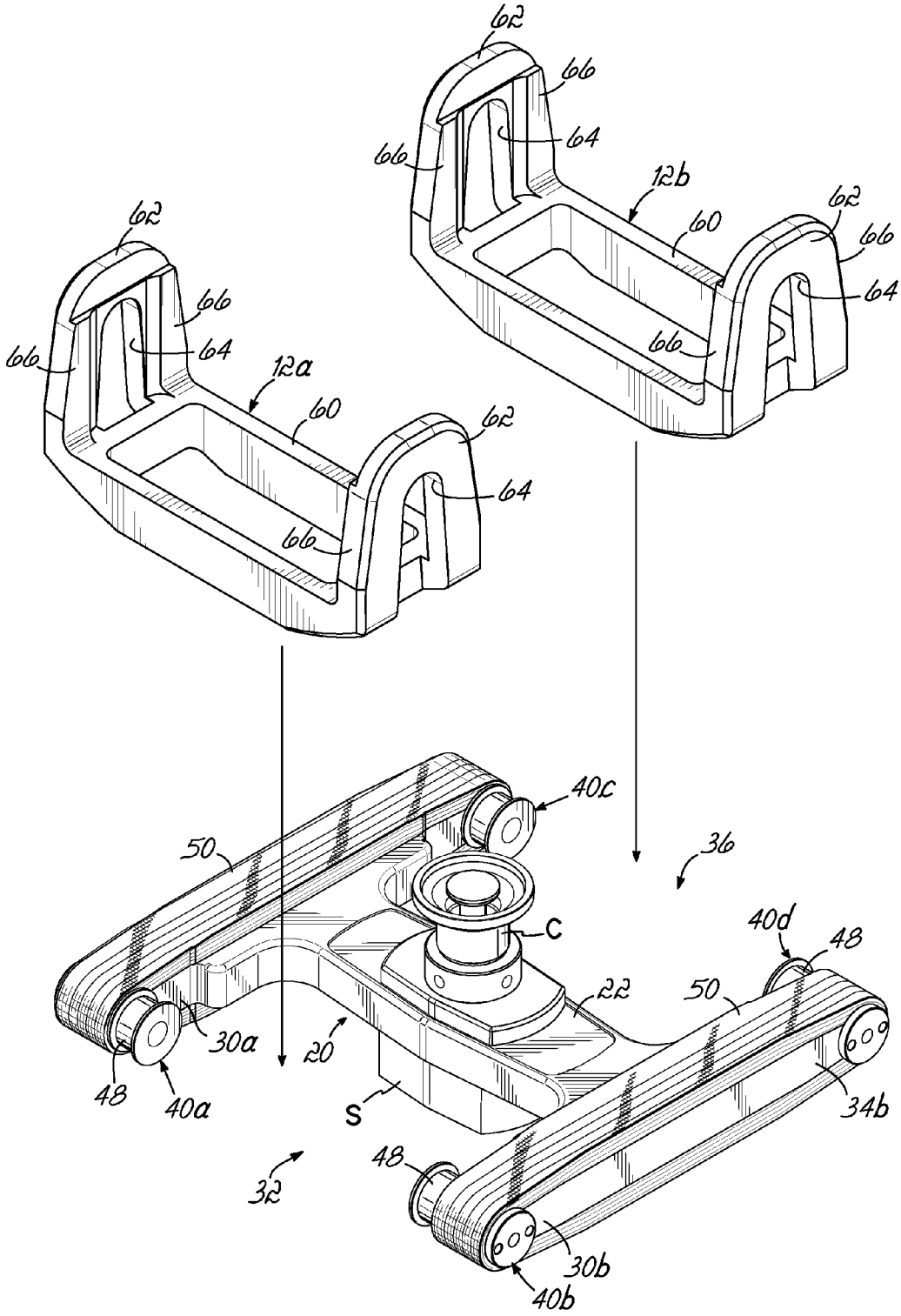
FIG. 2D is a perspective view of a carbon fiber wound H-rotor according to one embodiment of the present invention, illustrating the placement of swing buckets on bucket supports.
Figure 2E:
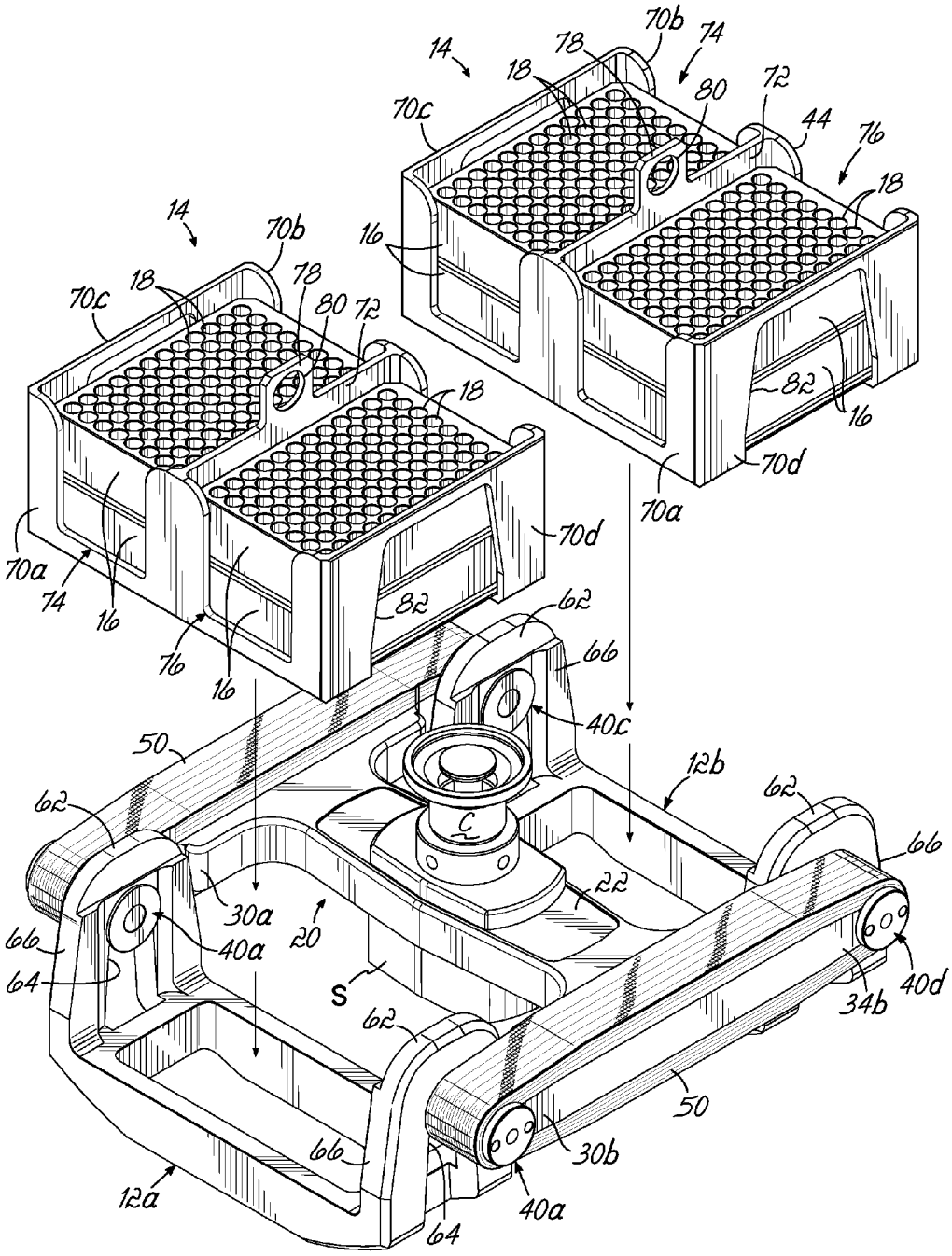
FIG. 2E is a perspective view of the H-rotor assembly of FIG. 2D, illustrating the placement of microplate trays including stacked microplates, onto the swing buckets.

Referring now to FIGS. 2D and 2E, the first and second pairs of bucket supports 40*a*, 40*b*, 40*c*, 40*d* are positioned and configured to receive and pivotally support swing buckets 12*a*, 12*b* with the respective first and second bucket receiving spaces 32, 36. In the embodiment shown, the swing buckets 12*a*, 12*b* comprise a frame structure having a generally rectangular base 60 and upwardly extending ears 62 disposed on opposite ends of the base 60. A slotted aperture 64 is formed through each ear 62 and is configured to be received over the trunion 48 of one of the bucket supports 40*a*, 40*b*, 40*c*, 40*d* associated with the bucket receiving spaces 32, 34 such that the swing buckets 12*a*, 12*b* are pivotally supported thereon, as illustrated in FIG. 2E. The swing buckets 12*a*, 12*b* further include stepped projections 66 provided on respective inwardly facing sides of the ears 62 for engaging and retaining the microplate carriers 14 on the swing buckets 12*a*, 12*b*.

With reference to FIG. 2E, each microplate carrier 14 comprises a generally rectangular frame having outer sidewalls 70*a*, 70*b*, 70*c*, 70*d* and a central wall 72 defining first and second bays 74, 76 for receiving and supporting tandem stacks of microplates 16 therein. A tab 78 projecting vertically from the central wall 72 has an aperture 80 therethrough to facilitate loading the carriers 14 into and unloading the carriers 14 from the swing buckets 12*a*, 12*b*. Apertures 82 formed through oppositely disposed sidewalls 70*c*, 70*d* of the carriers 14 are shaped complementarily to the projections 66 on the ears 62 of the swing buckets 12*a*, 12*b* such that the projections 66 engage and help to retain the carriers 14 on the swing buckets 12*a*, 12*b* when the carriers 14 are seated on the swing buckets 12*a*, 12*b* for centrifugation, as depicted in FIGS. 1 and 3A.

Figure 3A:
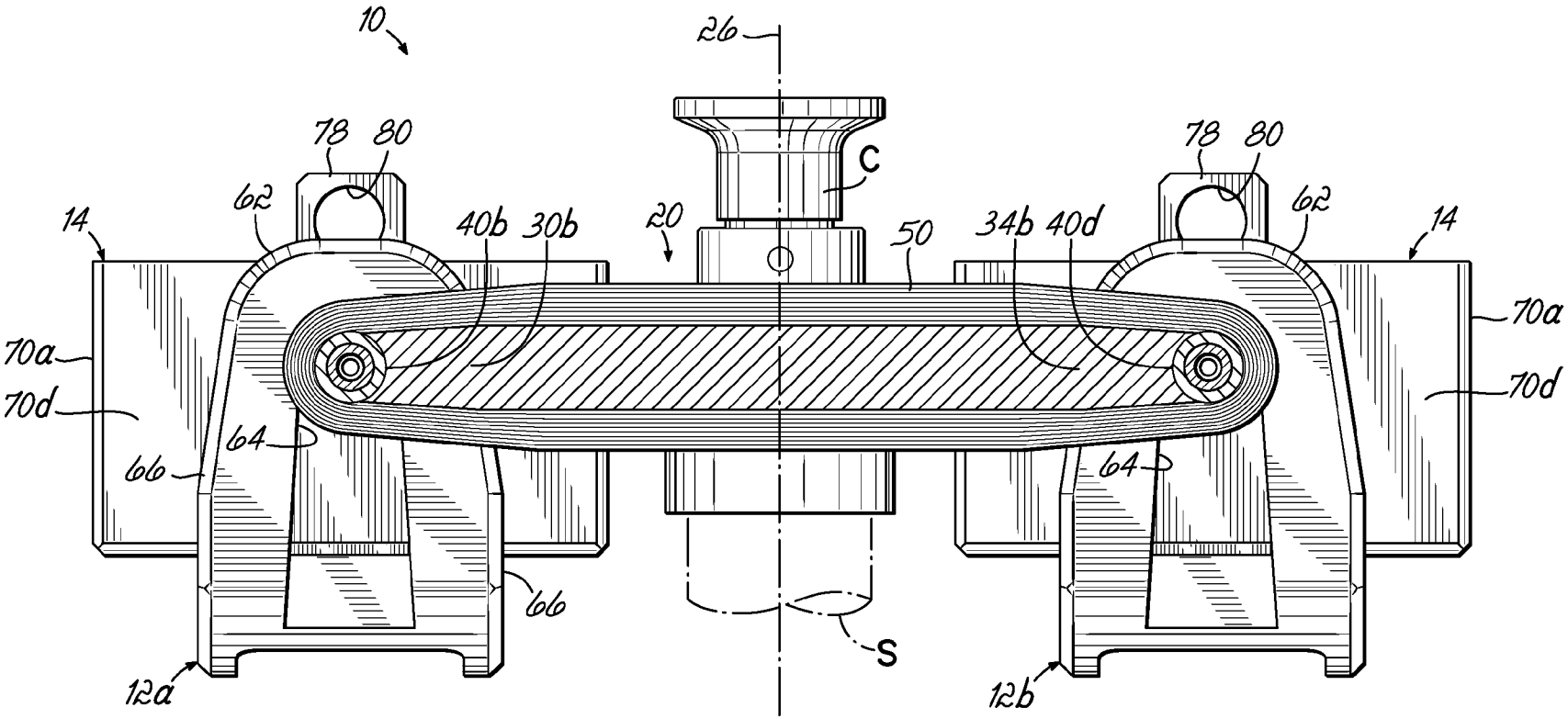
FIG. 3A is a partial cross-sectional elevation view of the H-rotor assembly of FIG. 1, taken along line 3A-3A, and depicting the H-rotor assembly at rest.
Figure 3B:
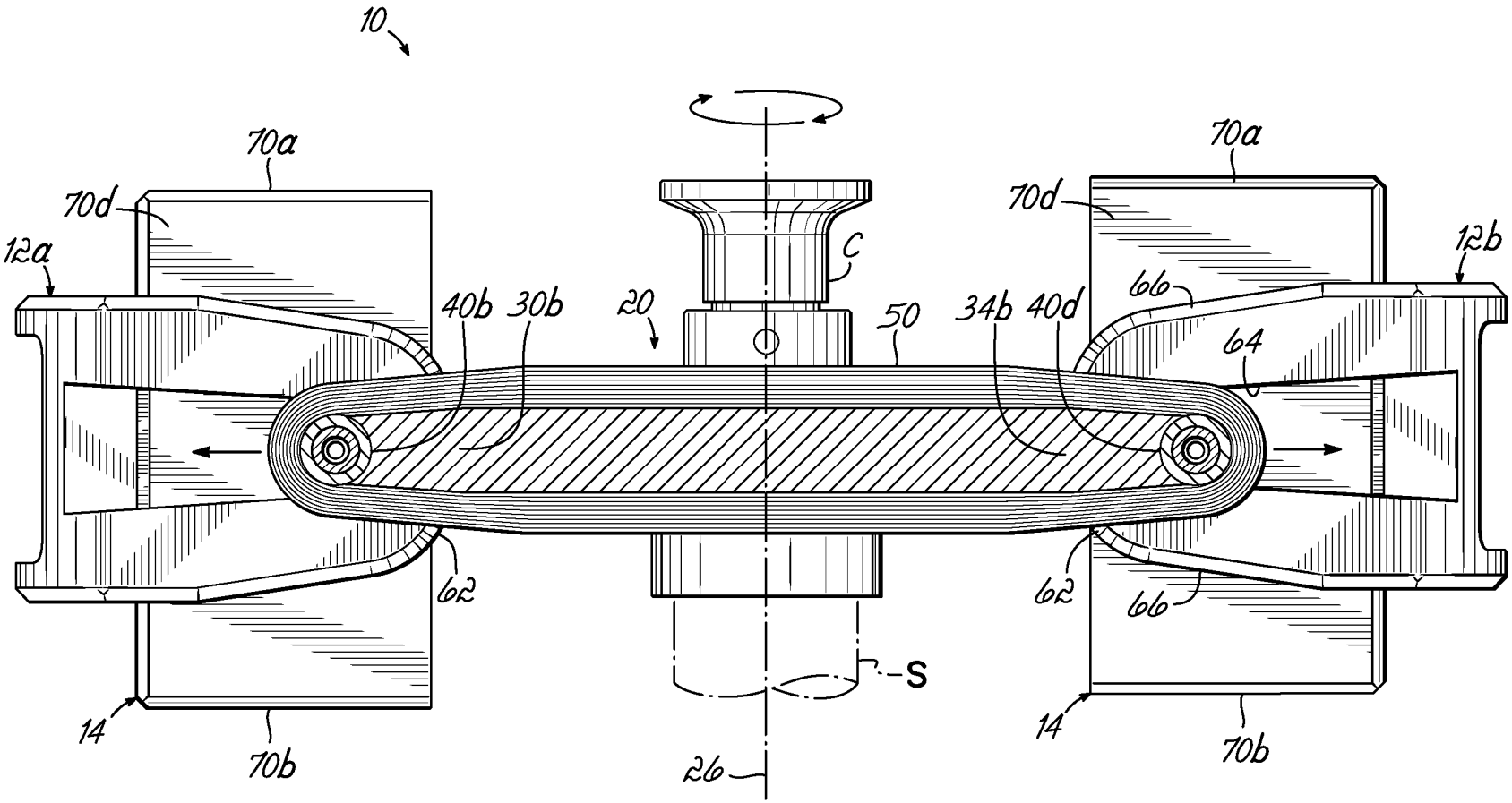
FIG. 3B is a partial cross-sectional view of the H-rotor assembly of FIG. 3A, depicting the H-rotor assembly during centrifugation.

FIG. 3A is a partial cross sectional view depicting the centrifuge rotor assembly 10 supporting the swing buckets 12*a*, 12*b* and carriers 14 while the rotor assembly 10 is not rotating. The swing buckets 12*a*, 12*b* hang pendulously from the bucket supports 40*a*, 40*b*, 40*c*, 40*d* such that the longitudinal axes of the cells 18 of the microplates 16 housed in the carriers 14 are aligned substantially parallel with the rotational axis 26 of the rotor body 20. FIG. 3B depicts the centrifuge rotor assembly 10 of FIG. 3A during rapid rotation of the centrifuge rotor assembly 10 about its rotational axis 26. During rapid rotation, the swing buckets 12*a*, 12*b* pivot about the bucket supports 40*a*, 40*b*, 40*c*, 40*d* such that the bases 60 of the swing buckets 12*a*, 12*b* are rotated in directions generally radially outwardly from the central hub 22, whereby the longitudinal axes of the wells 18 of the microplates 16 may be aligned substantially perpendicular to the rotational axis 26 of the rotor body 20. During such rapid rotation of the centrifuge rotor assembly 10, the reinforcing material 50 wound around the respective bucket supports 40*a*, 40*b*, 40*c*, 40*d* reacts against inertial forces applied to the bucket supports 40*a*, 40*b*, 40*c*, 40*d* by the loaded swing buckets 12*a*, 12*b*.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A method of making a centrifuge rotor having a rotor body including a central hub, a first pair of arms extending from the central hub and defining a first bucket receiving space and a second pair of arms extending from the central hub and defining a second bucket receiving space, comprising:

supporting a first pair of spaced apart bucket supports by the first pair of arms for pivotally supporting a first swing bucket in the first bucket receiving space;

supporting a second pair of spaced apart bucket supports by the second pair of arms for pivotally supporting a second swing bucket in the second bucket receiving space diametrically opposite the first bucket receiving space;

winding reinforcing material around one of the first pair of bucket supports and an oppositely disposed one of the second pair of bucket supports by directing the reinforcing material along one of the first pair of arms and an oppositely disposed one of the second pair of arms as the reinforcing material is wound around one of the first pair and one of the second pair of bucket supports; and winding reinforcing material around the other one of the first pair of bucket supports and the oppositely disposed other one of the second pair of bucket supports by directing the reinforcing material along the other one of the first pair of arms and an oppositely disposed one of the second pair of arms as the reinforcing material is wound around the other one of the first pair and the other one of the second pair of bucket supports.

2. The method of claim 1, wherein the reinforcing material comprises resin-coated carbon fibers, the method further comprising:

curing the resin-coated carbon fiber reinforcing material.

3. The method of claim 1, further comprising:

forming the rotor body from carbon-fiber laminate material.

* * * * *